United States Patent [19]

Wohner et al.

[11] Patent Number: 4,591,366

[45] Date of Patent: May 27, 1986

[54] METHOD OF SUBSEQUENT TREATMENT OF SULFUR GAS FROM WASTE PYROLYSIS

[75] Inventors: Hans J. Wohner; Wilfried Pappmann; Peter Diemer, all of Essen, Fed. Rep. of Germany

[73] Assignee: Krupp-Koppers GmbH, Essen, Fed. Rep. of Germany

[21] Appl. No.: 731,478

[22] Filed: May 7, 1985

[30] Foreign Application Priority Data

Jun. 8, 1984 [DE] Fed. Rep. of Germany ..... 3421393

[51] Int. Cl.[4] ..... B01D 47/10

[52] U.S. Cl. ..... 55/20; 55/89; 55/94; 55/229

[58] Field of Search ..... 55/20, 23, 24, 89, 93, 55/94, 223, 227, 229; 62/28

[56] References Cited

U.S. PATENT DOCUMENTS

| | | | |
|---|---|---|---|
| 3,518,812 | 7/1970 | Kolm | 55/94 |
| 4,149,859 | 4/1979 | Vigesdal | 55/93 |
| 4,469,493 | 9/1984 | Fuovinen et al. | 55/89 |

*Primary Examiner*—Charles Hart

*Attorney, Agent, or Firm*—Michael J. Striker

[57] ABSTRACT

In a method of subsequent treatment of sulfur gas from waste pyrolysis, the sulfur gas is cooled after hot dust removal in many stages to an end temperature between 0° and 5° C., wherein the components [condensate] separated from the gas are subdivided into a heavy tar, an oil and a water phase. The obtained heavy tar is supplied back to the pyrolysis reactor, whereas the oil phase is again used partially or completely for gas treatment, and the separated water is discharged from the process. The end product of the method is a stable gas which can be used for heating.

9 Claims, 1 Drawing Figure

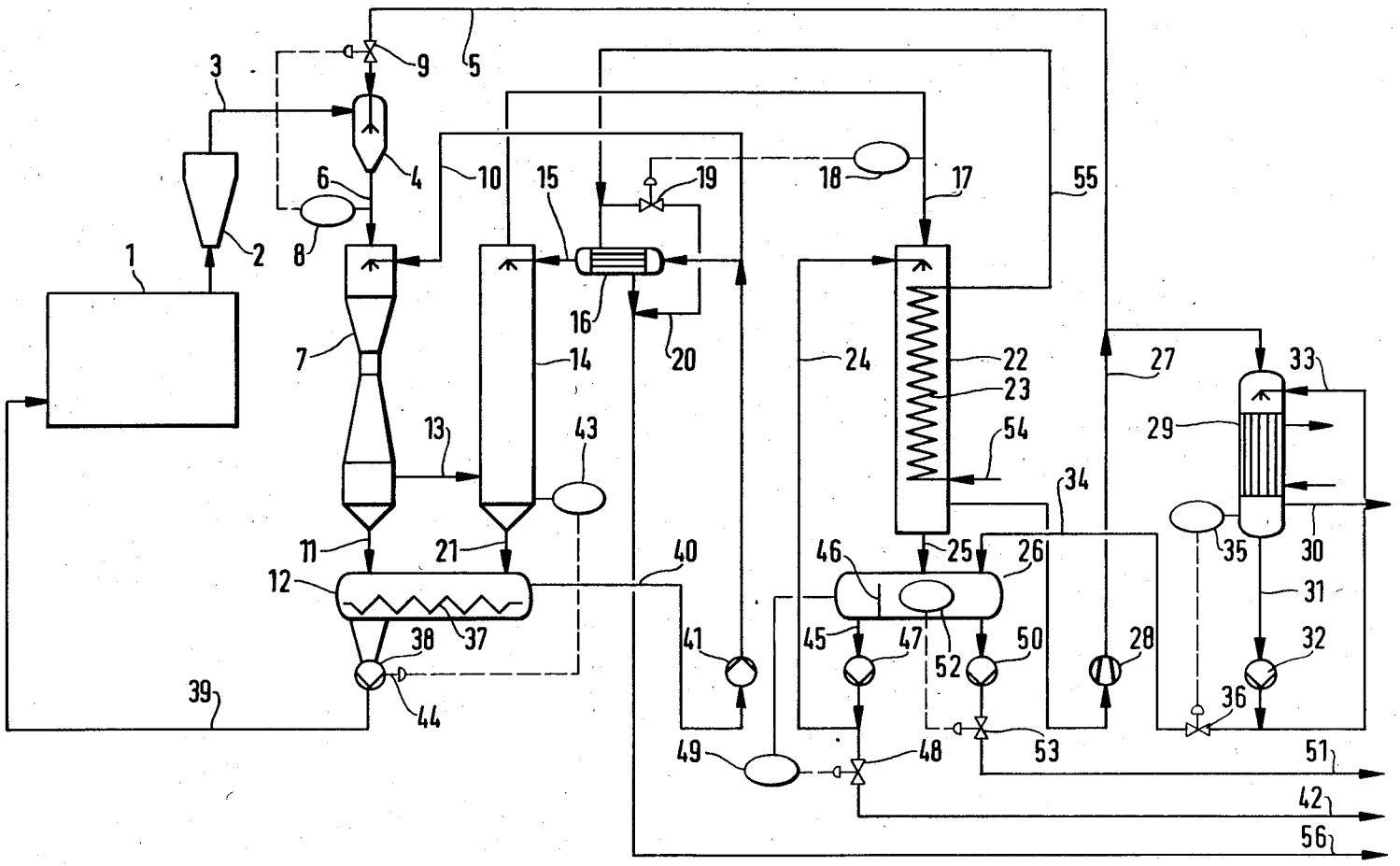
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56

METHOD OF SUBSEQUENT TREATMENT OF SULFUR GAS FROM WASTE PYROLYSIS

BACKGROUND OF THE INVENTION

The present invention relates to a method of subsequent treatment of hydrocarbon containing sulfur gas obtained during pyrolysis of wastes which contain organic materials, for example home garbage, wherein water and liquid hydrocarbons are separated from the gas.

The pyrolysis of wastes which contain organic materials, especially home garbage, is nowadays performed in some cases with addition of carbon, advantageously in closed revolving tubular furnaces with exclusion of air. Conversion of the introduced wastes to sulfur coke takes place in the revolving tubular furnace which serves as a pyrolysis reactor, under the action of heating of its lateral wall. Simultaneously a sulfur gas is exhausted and contains in addition to gaseous hydrocarbons, also liquid hydrocarbons as well as water as condenseable components. The combustion of the obtained sulfur gas without subsequent gas treatment is prohibited on economical grounds. Rather the goal is to separate the liquid hydrocarbons contained in the gas and often identified as pyrolysis oil, and to supply the same for a special use. In the German published patent application No. DE-OS 3,227,896 it is proposed to separate the obtained sulfur gas by condensation into three fractions, namely water, liquid hydrocarbons and gaseous hydrocarbons. It is to be understood that these three fractions can be treated or subsequently treated in different manner. Since the obtained gaseous fraction cannot be used directly on the device for indirect heating of internal consumer, the gas must be supplied to another utilization, for example for heating or synthesis purposes, or also for producing electric energy. This presumes however a stable gas.

SUMMARY OF THE INVENTION

Accordingly, it is an object of the present invention to provide a method of subsequent treatment of sulfur gas obtained during waste pyrolysis, which avoids the disadvantages of the prior art.

More particularly, it is an object of the present invention to provide a method of subsequent treatment of sulfur gas obtained during waste pyrolysis, in which the gas obtained as an end product is stable over a longer time and in some cases can be fed into another gas supply system. In accordance with the inventive method it is to be understood that the liquid hydrocarbons and water available in the gas must be separated in maximum quantity. Simultaneously, use of foreign reactants in the method can be dispensed with.

In keeping with these objects and with others which become apparent herein after, one feature of the present invention resides, briefly stated, in a method in accordance with which a gas exiting a pyrolysis reactor is precooled after a hot dust removal to a gas temperature between 200° and 350° C. and the gas temperature is adjusted so that it lies above the dew point of the higher boiling hydrocarbons contained in the gas. The gas after the precooling is subjected to a fine dust removal in a Venturi washer with addition of own condensate, the gas emerging from the Venturi washer is cooled in a direct cooler in counterstream with cooled own condensate to a gas output temperature between 60° and 120° C. and the gas temperature is adjusted so that it lies above the dew point of water vapor contained in the gas, the gas is then cooled in an indirect cooler to a gas outlet temperature of 20°-30° C. and simultaneously is sprayed with own condensate as spraying medium, the gas is finally brought in an indirect final cooler to an end temperature of between 0° and 5° C. and supplied to its further use or intermediate storage, the components [condensate] separated in the Venturi washer and in the direct cooler from the gas are drawn to a first separating container and there separated into a heavy tar and an oil phase whereas the obtained oil containing heavy tar is supplied for further conversion into the pyrolysis reactor and the oil phase is subsequently used completely or partially as so-called own condensate for gas treatment in the Venturi washer and in the direct cooler and the components [condensate] separated in the indirect cooler from the gas are drawn to a second separating container and then separated into a water and an oil phase wherein the separated water is directly discharged from the process while the oil phase is completely or partially used subsequently as so-called own condensate for gas treatment in the indirect cooler.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view showing a flow diagram of a method in accordance with the present invention.

DESCRIPTION OF A PREFERRED EMBODIMENT

In the flow diagram illustrating a method in accordance with the present invention, reference numeral 1 identifies a pyrolysis reactor. It can be formed as a closed revolving tubular furnace. It is to be understood that also other types of reactors can be used, such as for example a fluidized bed reactor. It is believed to be unnecessary to describe in detail the pyrolysis process since the inventive method is not limited to certain process conditions during the pyrolysis in the reactor.

A hot sulfur gas emerging from the pyrolysis reactor at a temperature of approximately 450°-700° C. is first supplied into a dust separator 2 in which a great part of entrained coke dust is separated from the gas. The dust separator 2 can be of any type which is suitable for this purpose, for example such as a cyclone. At the end of the dust removal the gas reaches via a conduit 3 a gas quencher 4. A partial stream of the cold gas obtained in an indirect cooler 22 is also supplied via a conduit 5 into the gas quencher 4. In the gas quencher 4 the hot gas coming from the pyrolysis reactor 1 is precooled by direct contact with the recirculated cold gas to a temperature between 200 and 350° C. The gas is supplied via a conduit 6 into a Venturi washer [scrubber] 7. The gas temperature must be adjusted within a given temperature region so that it lies above the dew point of higher boiling hydrocarbons contained in the gas. This is performed by means of a temperature regulator 8 which measures the temperature of the gas stream flowing in the conduit 6, compares the same with the predetermined nominal value, and in correspondence with respective deviation opens or throttles a valve 9 in the conduit 5. Thereby the supply of cold gas via this conduit is correspondingly increased or reduced until the desired temperature of the gas in the conduit 6 is adjusted.

The precooled gas passes from the conduit 6 from above into the Venturi washer 7 which is loaded via the conduit 10 with so-called own condensate. This own condensate is high boiling hydrocarbons [heavy to medium oil] which are separated from the gas. The own condensate supplied via the conduit 10 has a temperature of 100°–200° C. Fine dust removal from the gas is performed in the Venturi washer 7 by means of the added own condensate, on the one hand, and the used condensation of the higher boiling hydrocarbons, on the other hand. The components separated from the gas are drawn via a conduit 11 into a so-called first separating container 12, whereas the dust-clean gas is supplied via a conduit 13 from below into a direct cooler 14.

The gas is cooled in the direct cooler 14 to a gas outlet temperature between 60° and 120° C., in direct contact with the own condensate supplied via a conduit 15. For this purpose the own condensate via the conduit 15 is cooled in an indirect cooler 16 to a temperature between 60° and 100° C. The gas temperature in the direct cooler 14 is adjusted so that it lies above the dew point temperature of the water vapor contained in the gas.

The gas emerging from the direct cooler 14 reaches via a conduit 17 in an indirect cooler 22. The gas outlet temperature in the conduit 17 is monitored and controlled by a temperature regulator 18. It works in accordance with the same principle as the temperature regulator 8 and actuates a valve 19 which is installed in a cold water-bypass conduit 20. The cold water supply to the indirect cooler 16 can be controlled via this bypass conduit 20 and thereby its output can be influenced. It is also possible to influence the temperature of the own condensate supplied via the conduit 15 to the direct cooler 14 and thereby to guarantee the desired cooling effect in the direct cooler 14. The higher boiling hydrocarbons contained in the gas are condensed on the free surfaces of the cooled own condensate. The components separated from the gas are supplied via a conduit 21 also to the first separating container 12.

The gas is supplied from the conduit 17 from above into the indirect cooler 22 in which it is cooled to a gas outlet temperature of 20°–30° C. For preventing depositing and dirtying on a cooling coil 23, the gas is simultaneously sprayed with own condensate which is fed via a conduit 24 into the indirect cooler 22. The components separated from the gas are drawn via a conduit 25 and reach in a so-called separating container 26. The respectively cooled gas is drawn via a conduit 27 to the direct cooler 22 and pressed by a gas exhauster 28 in an indirect final cooler 29 in which its cooling is performed to an end temperature between 0° and 5° C. A partial stream of the gas is however branched in the conduit 27 via the conduit 5 and supplied to the gas quencher 4. The quantity of this partial stream is controlled, as described herein above, by the temperature regulator 8 with the aid of the valve 9.

The gas cooled in the indirect final cooler 29 is drawn via a conduit 30 and supplied for its further use or an intermediate storage. The water-free condensate separated in the final cooler 29 is drawn by means of a pump 32 via a conduit 31. A partial stream of this condensate can be fed to the final cooler 29 via a conduit 32 for the purpose of spraying, whereas the excessive condensate is supplied via a conduit 34 to the separating container 26. The quantity of the condensate drawn through the conduit 34 is controlled by a regulator 35 which controls a valve 36 in dependence upon the liquid level at the bottom of the final cooler 29. When the liquid level rises over a predetermined nominal value the valve 36 automatically opens, whereas during lowering of the liquid level below the nominal value it is automatically closed.

The solid-to-liquid gas components [condensate]-drawn from the Venturi washer 7 and the direct cooler 14 are separated in the first separating container 12 into an oil-containing heavy tar and an oil phase. The separating container 12 can be formed as a tar separator of conventional design as used in coking furnace gas treatment. The obtained oil-containing heavy tar which contains the dust separated in the Venturi washer 7 is collected on the bottom of the separating container 12 and removed by means of a conveyor screw 37 from the separating container 12. It is transported back via a conduit 39 by a pump 38 into the pyrolysis reactor 1 and converted there. The oil phase which is separated as a light phase over the heavy tar is drawn by a conduit 40 from the separating container 12 and pressed by a pump 41 into the conduits 10 and 15 through which it is added to the Venturi washer 7 and the indirect cooler 14. The quantity of the drawn oil-containing heavy tar is controlled by a regulator 43 which actuates a rotary speed regulator 44 in dependency on the liquid level on the bottom of the direct cooler 14. The regulator 43 operates so that with increasing liquid level the rotary speed of the pump 38 and thereby its feed output is increased, whereas with lowering liquid level the rotary speed and the feed output of the pump 38 is throttled.

The liquid gas components [condensates]separated in the indirect cooler 22 are substantially a water containing light oil fraction which is separated in the second separating container 26 into an oil and a water phase. The oil phase which is separated over the water phase is drawn via an overflow 46 and a conduit 45 into the separating container 26 and pressed by a pump 47 in the conduit 24. Via this conduit, feeding to the indirect cooler 22 is performed. The conduit 24 is connected via a valve 48 with the conduit 42, so that the excessive oil can be removed from the circulation and drawn through the conduit 42. It is a light oil with a boiling region of approximately 30°–30° C. The valve 48 is actuated by a regulator 49, and the control is performed in the above described manner in dependence on the liquid level in the separating container 26. The water separated in the separating container 26 is pressed by a pump 50 into a conduit 51 and is removed from the process via the latter. The water can be supplied to a biological waste water treatment device or destroyed in another manner.

A regulator 52 controls via a valve 53 the water withdrawal in dependence on the level of the water phase in the separating container 26. It is to be understood that in deviation from the above described example the oil fractions obtained in the individual method steps can also be separately drawn and utilized, when it is desirable because of the operational conditions.

The indirect coolers 16 and 22 are connected with one another by a common cooling water circulating circuit. The cooling water which in some cases is provided with a freezing-preventing medium is supplied via a conduit 54 to the cooling coil 23 of the indirect cooler 22. From there it passes via a conduit 54 to the indirect cooler 16 and is drawn from the latter via a conduit 56. The drawn cooling water can be again used in correspondence with respective return cooling. It is to be understood that the inventive method is not limited to the construction of the shown cooler. Other cooler types can also be used.

With the use of the inventive method the gas composition is changed as follows. While the partially dust-removed gas in the conduit 3 has a composition in the following region:

$CO_2$: 16–20 Vol.-%
CO: 14–18 Vol.-%
$H_2$: 1–5 Vol.-%
$O_2$: 0.1–1.0 Vol.-%
$N_2$: 34–40 Vol.-%
$H_2S$: 0.01–0.2 Vol.-%
$NH_3$: 1–2 Vol.-%
$CH_4$: 6–8 Vol.-%
$C_nH_m$: 14–18 Vol.-%, the composition of the cleaned gas drawn over the conduit 30 lies in the following region:

$CO_2$: 18–21 Vol.-%
CO: 16–19 Vol.-%
$H_2$: 1–5 Vol.-%
$O_2$: 0.1–1.0 Vol.-%
$H_2S$: 0.01–0.2 Vol.-%
$NH_3$: 0.05–0.5 Vol.-%
$CH_4$: 6–9 Vol.-%
$C_nH_m$: 9–12 Vol.-%

This gas is completely stable at low temperatures and can be used without difficulties as heating gas. Since moreover in accordance with the inventive method the obtained own condensate is used for gas treatment, the use of foreign reactants can be dispensed with. The elimination of the obtained heavy tar does not pose any problem in the inventive method since it is returned to the pyrolysis reactor.

It will be understood that each of the elements described above, or two or more together, may also find a useful application in other types of constructions differing from the types described above.

While the invention has been illustrated and described as embodied in a method of subsequent treatment of hydrocarbon containing sulfur gas obtained during pyrolysis of wastes containing substances, such as home garbage, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of subsequent treatment of hydrocarbon containing sulfur gas obtained during pyrolysis of wastes containing organic substances, particularly of home garbage, comprising the steps of (a) precooling a gas exiting a pyrolysis reactor after its hot dust removal to a gas temperature 200° C. and 350° C. with adjusting the gas temperature so that it lies above a dew point of higher boiling hydrocarbons contained in the gas;

(b) subjecting the gas after the precooling to a fine dust removal in a Venturi washer with addition of own condensate;

(c) cooling the dust-removed gas exiting the Venturi washer in a direct cooler in counterstream with the cooled own condensate to a temperature between 60° and 120° C. with adjusting the gas temperature so that it lies above a dew point of water vapor contained in the gas;

(d) cooling subsequently the gas in an indirect cooler to a gas outlet temperature of 20°–30° C. with simultaneous spraying of the same by the own condensate as a spraying medium;

(e) bringing the gas subsequently in an indirect final cooler to an end temperature of between 0° and 5° C. to supply the same to a further use or intermediate storing;

(f) drawing in a first separating container, components which are separated in the Venturi washer and the direct cooler from the gas and separating the components in the separating container into a heavy tar and a oil phase, with supplying the obtained oil containing heavy tar to a further conversion in the pyrolysis reactor and using the oil phase completely or partially as own condensate for gas treating in the Venturi washer and in the direct cooler; and (g) drawing in a second separating container components separated in the indirect cooler from the gas and separating the same in the second separating container into a water and oil phase with directly discharging the separated water and using the oil phase completely or partially as own condensate for gas treating in the indirect cooler.

2. A method as defined in claim 1, wherein said step of precooling the gas includes precooling by gas quenching with a partial stream of the cold gas obtained behind the indirect cooler.

3. A method as defined in claim 1, wherein said step of precooling the gas includes precooling by indirect cooling with a heat carrier.

4. A method as defined in claim 2; and further comprising the step of controlling the quantity of the cold gas supplied to the gas quenching, in dependence on the gas temperature of the precooled gas behind the gas quenching.

5. A method as defined in claim 1, wherein said step of using the own condensate in the Venturi washer includes feeding the own condensate to the Venturi washer with a temperature of 100°–200° C.

6. A method as defined in claim 1, wherein said step of using the own condensate in the direct cooler includes feeding the own condensate to the direct cooler with a temperature of 60°–100° C.

7. A method as defined in claim 1; and further comprising the step of controlling the gas outlet temperature behind the direct cooler by respective cooling of the own condensate fed to the direct cooler.

8. A method as defined in claim 1; and further comprising the step of discharging the oil phase which is separated in the separating containers and not used again as the own condensate for gas treatment.

9. A method as defined in claim 1; and further comprising the step of using a part of the condensate separated in the final cooler as a spraying medium in the final cooler.

* * * * *